US007504774B2

(12) United States Patent
Lim

(10) Patent No.: US 7,504,774 B2
(45) Date of Patent: Mar. 17, 2009

(54) PLASMA DISPLAY PANEL WITH HIGH BRIGHTNESS AND IMPROVED COLOR TEMPERATURE

(75) Inventor: Sung-Hyum Lim, Suwon-si (KR)

(73) Assignee: Samsung SDI Co., Ltd., Gyeonggi-Do (KR)

( * ) Notice: Subject to any disclaimer, the term of this patent is extended or adjusted under 35 U.S.C. 154(b) by 136 days.

(21) Appl. No.: 11/436,492

(22) Filed: May 15, 2006

(65) Prior Publication Data

US 2006/0255730 A1 Nov. 16, 2006

(30) Foreign Application Priority Data

May 16, 2005 (KR) ..... 10-2005-0040555

(51) Int. Cl.
*H01J 17/49* (2006.01)

(52) U.S. Cl. ..... 313/582; 313/584

(58) Field of Classification Search ..... 313/582–587
See application file for complete search history.

(56) References Cited

U.S. PATENT DOCUMENTS 6,348,762 B1 * 2/2002 Nunomura et al. ..... 313/582
6,411,032 B1 * 6/2002 Shiiki et al. ..... 313/582
2002/0008473 A1 1/2002 Kanazawa
2003/0127983 A1 7/2003 Park
2004/0113556 A1 * 6/2004 Huang et al. ..... 313/586

FOREIGN PATENT DOCUMENTS

EP 1 030 340 A2 8/2000
KR 1020040016013 A 2/2004

* cited by examiner

*Primary Examiner*—Joseph L Williams
(74) *Attorney, Agent, or Firm*—Knobbe Martens Olson & Bear LLP

(57) ABSTRACT

Provided is a plasma display panel (PDP). The PDP includes a first substrate; a second substrate disposed parallel to the first substrate; partition walls disposed between the first and second substrates and for defining discharge cells in which gas discharge occurs; phosphor layers, each phosphor layer disposed in one of the discharge cells and formed by coating any one of red, green, and blue phosphors; and discharge electrodes for provoking gas discharge. In a unit pixel including three discharge cells in which respectively different phosphor layers are disposed, a pair of discharge electrodes, which cause gas discharge, are disposed such that the discharge electrodes cross the respective discharge cells positioned in the unit pixel, and the area in which the discharge electrodes cross at least one discharge cell is different from the area in which the discharge electrodes cross the other discharge cells.

7 Claims, 3 Drawing Sheets

PLASMA DISPLAY PANEL WITH HIGH BRIGHTNESS AND IMPROVED COLOR TEMPERATURE

CROSS-REFERENCE TO RELATED APPLICATIONS

This application claims the benefit of Korean Patent Application No. 10-2005-0040555, filed on May 16, 2005, in the Korean Intellectual Property Office, the disclosure of which is incorporated herein in its entirety by reference.

BACKGROUND OF THE INVENTION

1. Field of the Invention

The present embodiments relate to a plasma display panel (PDP), and more particularly, to a PDP that keeps up high brightness and has improved color temperature.

2. Description of the Related Art

A PDP is a flat panel display (FPD) that produces an image using gas discharge and has lately attracted much attention because it can be thinned out and embody a high-quality large screen with a wide angular field.

PDPs includes a first substrate and a second substrate, which are spaced apart from each other opposite each other, partition walls, which serve to define discharge cells in which gas discharge occurs between the first and second substrates, a discharge gas, which is filled in the discharge cells to induce discharge, phosphor layers, which are coated on inner surfaces of the discharge cells, and electrodes between which a voltage is applied. In a PDP, discharge arises in the discharge cells due to a direct-current (DC) or alternating-current (AC) voltage applied between the electrodes, creating ultraviolet rays which excite phosphors of the phosphor layers. Thus, the phosphor layers emit visible rays to create an image.

For a conventional PDP, each of the discharge cells includes a phosphor layer formed of any one of red(R), green (G), or blue(B) phosphors (hereinafter, RGB phosphors). The phosphor layers are obtained by sequentially coating RGB phosphors one after another in serial discharge cells.

Three serial discharge cells (specifically, a discharge cell including an R phosphor layer, a discharge cell including a G phosphor layer, and a discharge cell including a B phosphor layer) interact with one another, thus forming a unit pixel.

A brightness ratio of RGB phosphors is typically known as about 28:62:10, and the color temperature of a peak generated in the unit pixel is about 8,000 K.

Generally, the larger the deviation in brightness ratio among the RGB phosphors becomes, the lower the color temperature becomes.

In this case, color temperature is a term that literally represents how hot or cold the color is. The color temperature is typically adjustable in the range of 6,500 to 9,300 K. Here, K is named after W. Thomas Kelvin (1824-1907) and refers to absolute temperature. As the numerical value of color temperature increases, color becomes brighter, colder, and bluer. Inversely, as the numerical value of color temperature decreases, color becomes warmer and redder. Although color temperature is a matter of individual preference, it is known that most people prefer high color temperature (i.e., blue color).

However, in the conventional PDP, a B phosphor has a much lower brightness ratio than R and G phosphors. Therefore, it is necessary to lower the brightness of the R and G phosphors in order to adjust color temperature to most consumers' preference. As a result, the entire brightness of the PDP is degraded.

SUMMARY OF THE INVENTION

The present embodiments provide a plasma display panel (PDP), which includes a plurality of pixels, wherein each unit pixel includes a plurality of discharge cells in which three different phosphor layers are formed. A discharge cell in which a blue (B) phosphor layer is formed is disposed at or near the middle of the unit pixel. A pair of discharge electrodes, which cause gas discharge, cross the respective discharge cells positioned in the unit pixel, and an area where the discharge electrodes cross at least one discharge cell differs from an area where they cross the other discharge cells. Therefore, the PDP structurally improves discharge cells and electrodes so that brightness can be maintained high and color temperature can be elevated.

According to an aspect of the present embodiments, there is provided a PDP including a first substrate; a second substrate disposed parallel to the first substrate; partition walls disposed between the first and second substrates and defining discharge cells in which gas discharge occurs; phosphor layers, each phosphor layer disposed in one of the discharge cells and formed by coating any one of red(R), green(G), or B phosphors; and discharge electrodes for provoking gas discharge. In a unit pixel including three discharge cells in which different phosphor layers are disposed respectively, a pair of discharge electrodes, which cause gas discharge, are disposed such that the discharge electrodes cross the respective discharge cells positioned in the unit pixel, and the area in which the discharge electrodes cross at least one discharge cell is different from the area in which the discharge electrodes cross the other discharge cells.

An area in which the discharge electrodes cross a discharge cell in which a B phosphor layer is formed may be largest among areas in which the discharge electrodes cross the respective discharge cells positioned in the unit pixel.

An area in which the discharge electrodes cross a discharge cell in which an R phosphor layer is formed may be smallest among areas where the discharge electrodes cross the respective discharge cells positioned in the unit pixel.

A discharge cell in which a blue phosphor layer is formed may be disposed at or near the middle of the unit pixel.

Each of the discharge electrodes may have the shape of a ladder formed in the unit pixel.

Each of the discharge electrodes may include a transparent electrode.

The transparent electrode may comprise indium tin oxide (ITO).

BRIEF DESCRIPTION OF THE DRAWINGS

The above and other features and advantages of the present embodiments will become more apparent by describing in detail exemplary embodiments thereof with reference to the attached drawings in which.

DETAILED DESCRIPTION OF THE INVENTION

A plasma display panel (PDP) according to the present embodiments will now be described more fully hereinafter with reference to the accompanying drawings, in which exemplary embodiments are shown.

Figure 1:
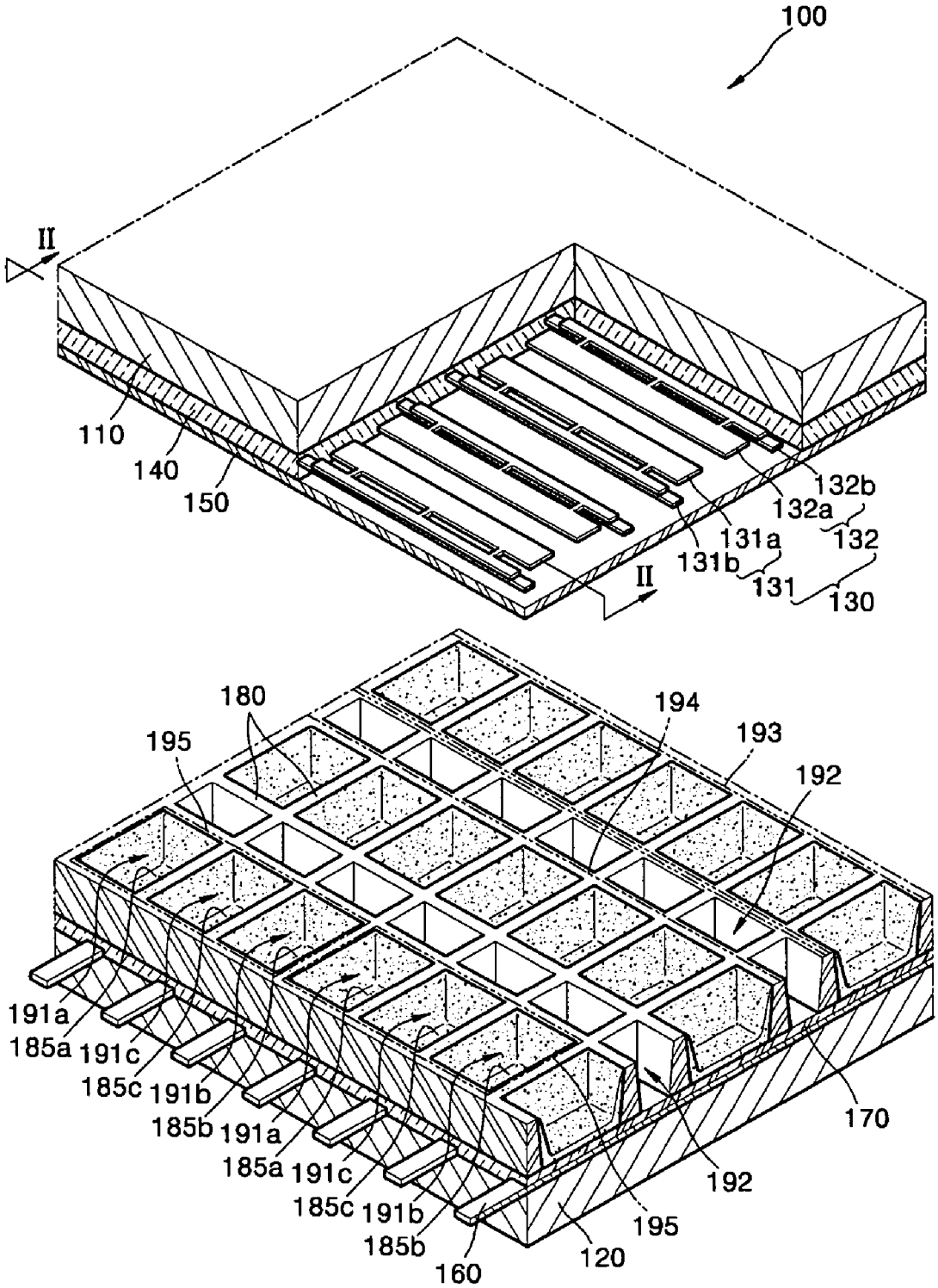
FIG. 1 is a discrete perspective view of a portion of a plasma display panel (PDP) according to an exemplary embodiment.
Figure 2:
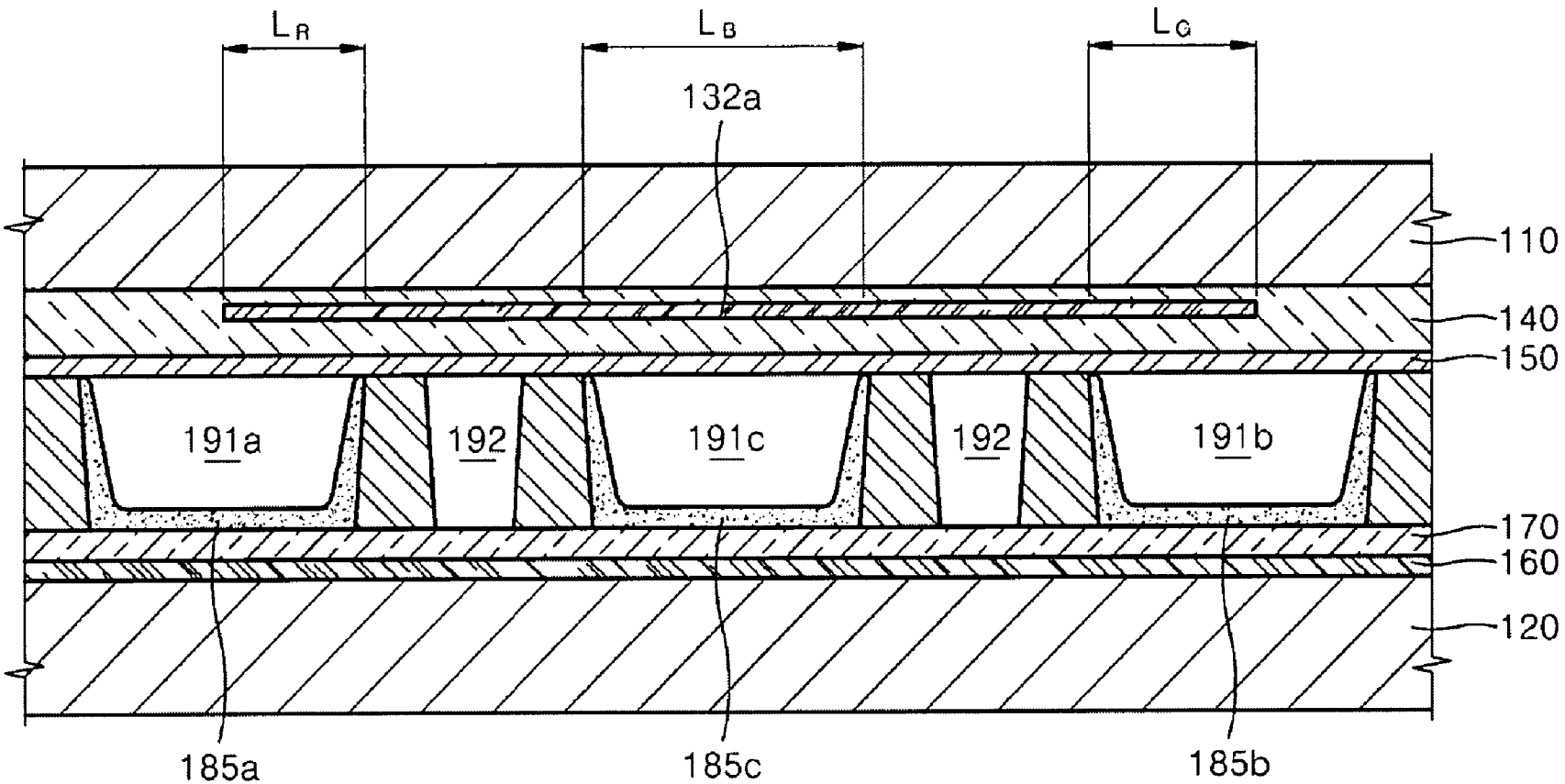
FIG. 2 is a discrete cross sectional view taken along a line II-II of FIG. 1.
Figure 3:
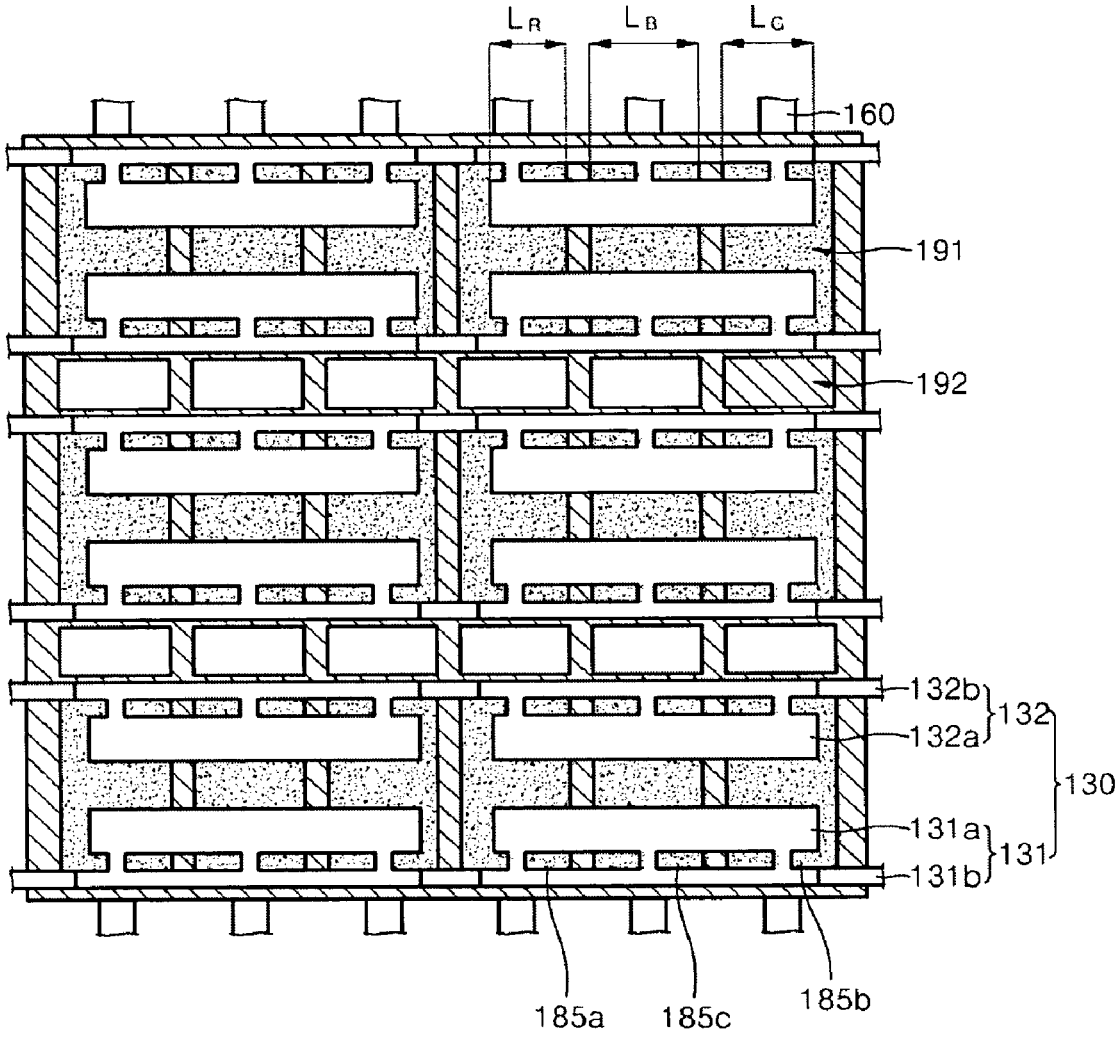
FIG. 3 is a partial plan view illustrating only the arrangement of partition walls and electrodes of FIG. 1.

FIG. 1 is a discrete perspective view of a portion of a plasma display panel (PDP) according to an exemplary embodiment, FIG. 2 is a discrete cross sectional view taken along a line II-II of FIG. 1, and FIG. 3 is a partial plan view illustrating only the arrangement of partition walls and electrodes of FIG. 1.

Referring to FIGS. 1 through 3, a PDP 100 according to an exemplary embodiment includes a first substrate 110, a second substrate 120, partition walls 180, a discharge gas (not shown), phosphor layers 185*a*, 185*b*, 185*c*, and electrodes 130 and 160. The first substrate 110 is disposed parallel to and apart from the second substrate 120. The partition walls 180 are interposed between the first and second substrates 110 and 120 and define discharge cells 191*a*, 191*b*, and 191*c* where gas discharge occurs and non-discharge cells 192 where no gas discharge occurs. The discharge gas is filled in the discharge cells 191*a*, 191*b*, and 191*c* and provokes discharge. The phosphor layers 185*a*, 185*b*, and 185*c* are disposed on inner surfaces of the discharge cells 191*a*, 191*b*, and 191*c*. Also, the electrodes 130 and 160 receive applied voltages.

The first substrate 110 may be formed of a transparent material such as glass. Also, a pair of discharge electrodes 130, namely, a common electrode 131 and a scan electrode 132, are disposed on the first substrate 110. The common electrode 131 may include a transparent electrode 131*a* and a bus electrode 131*b*, and the scan electrode 132 may include a transparent electrode 132*a* and a bus electrode 132*b*.

Although it is described in the present embodiment that the pair of discharge electrodes 130 are disposed on the first substrate 110, the present embodiments are not limited to the above-described arrangement. For example, the pair of discharge electrodes 130 may be spaced apart from the first substrate 110.

The bus electrodes 131*b* and 132*b* may be disposed above the partition walls 180 and spaced apart from top end surfaces of the partition walls 180.

A first dielectric layer 140 is disposed on the first substrate 110 to cover the pair of discharge electrodes 130. The first dielectric layer 140 prevents the adjacent common electrode 131 and scan electrode 132 from conducting during discharge and also inhibits charged particles from colliding with and damaging the pair of discharge electrodes 130. Also, the first dielectric layer 140 serves to induce the charged particles and accumulate wall charges. The first dielectric layer 140 may be formed of a dielectric material, such as $PbO \cdot B_2O_3 \cdot SiO_2$.

A protective layer 150 formed of MgO may be formed under the first dielectric layer 140. The protective layer 150 prevents the pair of discharge electrodes 130 from being damaged by sputtering of plasma particles and emits a large number of secondary electrons to lower the discharge voltage.

An address electrode 160 is formed on the second substrate 120. The address electrode 160 causes address discharge along with the scan electrode 132.

A second dielectric layer 170 is formed on the address electrode 160. The second dielectric layer 170 is used to protect the address electrode 160.

In the present embodiment, the PDP includes the address electrode 160 and the second dielectric layer 170. However, the PDP of the present embodiments covers configurations that do not include the address electrode 160 or the second dielectric layer 170 and is not limited to the above-described construction. That is, when there the address electrode 160 is not present, the common electrode 131 and the scan electrode 132 may cross each other so that a voltage can be applied between the two electrodes 131 and 132 to select the discharge cells 191*a*, 191*b*, and 191*c*.

The partition walls 180 are formed on the second dielectric layer 170 to prevent electrical and optical crosstalk among the discharge cells 191*a*, 191*b*, and 191*c*. The partition walls 180 partition the discharge cells 191*a*, 191*b*, and 191*c* where gas discharge occurs and the non-discharge cells 192 where no gas discharge occurs.

The discharge cells 191*a*, 191*b*, and 191*c* may have the same shape and form a plurality of discharge cell lines 193 in a direction in which the pair of discharge electrodes 130 extend. In one embodiment, the discharge cells 191*a*, 191*b*, and 191*c* may not have the same shape but have different shapes individually or in groups.

The non-discharge cells 192 are formed between the discharge cell lines 193 and form a plurality of non-discharge cell lines 194 in the direction in which the pair of discharge electrodes 130 extend. In the present embodiment, the partition walls 180 are formed such that the discharge cells 191*a*, 191*b*, and 191*c* and the non-discharge cells 192 have rectangular sectional shapes, but the present embodiments are not limited thereto. In addition to the rectangular sectional shape, the partition walls 180 may be formed such that the discharge cells 191*a*, 191*b*, and 191*c* and the non-discharge cells 192 have triangular, pentagonal, hexagonal, elliptical, circular, square or various other shapes.

The phosphor layers 185*a*, 185*b*, and 185*c* are formed of elements that absorb ultraviolet rays and generate visible rays. The red(R) phosphor layer 185*a* formed in the R emission discharge cell 191*a* is formed of a phosphor such as $Y(V,P)O_4$:Eu, the green(G) phosphor layer 185*b* formed in the G emission discharge cell 191*b* is formed of a phosphor such as $Zn_2SiO_4$:Mn, and the blue(B) phosphor layer 185*c* formed in the B emission discharge cell 191*c* is formed of a phosphor such as BAM:Eu.

Also, the three adjacent discharge cells, namely, the discharge cell 191*a* in which the R phosphor layer 185*a* is formed, the discharge cell 191*b* in which the G phosphor layer 185*b* is formed, and the discharge cell 191*c* in which the B phosphor layer 185*c* is formed, constitute a unit pixel 195.

After the first and second substrates 110 and 120 are bonded to each other, an inner space of the assembled PDP 100 contains air. Therefore, the air is completely evacuated from the assembled PDP 100 and an appropriate discharge gas is injected instead of the air to promote discharge efficiency. Generally, a gas mixture, such as, for example, Ne—Xe, He—Xe, or He—Ne—Xe, is used as the discharge gas.

Hereinafter, a method for improving color temperature without lowering the entire brightness in the PDP 100 of the present embodiments will be described in more detail with reference to the appended drawings.

Research in efficient use of cell structures has progressed along with developments in highly efficient PDPs. This research has lead to the disclosure of a cell structure in which a cell region is divided into the discharge cells 191*a*, 191*b*, and 191*c* where gas discharge happens and the non-discharge cells 192 where no gas discharge happens, in order to reduce unit light.

However, this structure for reducing unit light has some problems. For example, because phosphors are coated on the discharge cells 191*a*, 191*b*, and 191*c*, the ratio of a visible light emission area to the entire cell area decreases. Owing to the decrease in the visible light emission area, a B phosphor having the lowest brightness ratio becomes less luminous. As a result, the color temperature of a peak generated in the unit pixel 195 is dropped. Therefore, in order to obtain color temperature suitable for consumers' preference, R and G phosphors should decline in brightness. In other words, as color temperature is adjusted by lowering brightness, the entire brightness of the PDP 100 may deteriorate.

Accordingly, in order to inhibit deterioration of brightness caused by adjustment of color temperature while retaining high efficiency, the PDP 100 of the present embodiments includes the transparent electrodes 131*a* and 132*a*, which are separated in units of pixels 195 and bonded to the bus electrodes 131*b* and 132*b*. However, the method of forming the transparent electrodes 131*a* and 132*a* is not restricted to the above description. For example, the transparent electrodes 131*a* and 132*a* may be separated in units of discharge cells 191*a*, 191*b*, and 191*c* and bonded to the bus electrodes 131*b* and 132*b*.

In some embodiments, the transparent electrodes 131*a* and 132*a* may be formed of indium tin oxide (ITO).

An area where the transparent electrodes 131*a* and 132*a* cross the discharge cell 191*c* in which the B phosphor layer 185*c* is formed can be the largest among areas where they cross the discharge cells 191*a*, 191*b*, and 191*c* positioned in the unit pixel 195.

As a consequence, the brightness ratio of the B phosphor can be elevated. That is, by making the area where the transparent electrodes 131*a* and 132*a* cross the discharge cell 191*c* in which the B phosphor layer 185*c* is formed larger than the areas where they cross other discharge cells 191*a* and 191*b*, the discharge area can be maximized, thus the brightness of the B phosphor can be increased. As a result, the brightness ratio of the B phosphor to R and G phosphors can be elevated.

The area where the transparent electrodes 131*a* and 132*a* cross the discharge cell 191*a* in which the R phosphor layer 185*a* is formed is the smallest among the areas where they cross the discharge cells 191*a*, 191*b*, and 191*c* positioned in the unit pixel 195. As a result, a brightness ratio of the R phosphor to B and G phosphors can be reduced for the same reason as above.

As can be seen from FIGS. 2 and 3, the lengths of the transparent electrodes 131*a* and 132*a* are controlled such that $L_B$ is longest, $L_G$ is second longest, and $L_R$ is shortest. Thus, by elevating the brightness ratio of the B phosphor and dropping the brightness ratio of the R phosphor, color temperature can be elevated to a desired extent without additional downward adjustment of brightness. As a result, the entire brightness of the PDP 100 does not deteriorate.

In order to specifically attain the object of the present embodiments as described above, the discharge cell 191*c* in which the B phosphor layer 185*c* is formed may be interposed between the other discharge cells 191*a* and 191*b* in the unit pixel 195.

Furthermore, each of the transparent electrodes 131*a* and 132*a* may have the shape of a ladder formed in the unit pixel 195.

In this embodiment, the transparent electrodes 131*a* and 132*a* (especially the transparent electrode 132*a* can be seen from FIG. 2) completely cross the discharge cell 191*c* in which the B phosphor layer 185*c* is formed, above the discharge cell 191*c*, whereas they partially cross the other discharge cells 191*a* and 191*b* positioned in the same unit pixel 195 as the discharge cell 191*c*.

By varying lengths at which the transparent electrodes 131*a* and 132*a* cross the discharge cells 191*a*, 191*b*, and 191*c*, the crossing areas are made to be respectively different. As a result, the phosphor layers 185*a*, 185*b*, and 185*c* differ in discharge area, thus each of the phosphors can be adjusted to a desired brightness.

A process of operating the discharge cells 191*a*, 191*b*, and 191*c* of the PDP 100 according to an exemplary embodiment will now be described.

At the outset, once a voltage is applied from an external power supply, address discharge is caused by the address electrode 160 and the scan electrode 132. Subsequently, sustain discharge is induced by the scan electrode 132 and the common electrode 131. During the sustain discharge, the energy level of excited discharge gas is lowered, thus creating ultraviolet rays which excite phosphors of the phosphor layers 185*a*, 185*b*, and 185*c* disposed in the discharge cells 191*a*, 191*b*, and 191*c* respectively. While the energy level of excited phosphors is lowered, visible rays are emitted and transmitted through the first substrate 110, thus embodying an image that a user can perceive.

For a conventional PDP and the PDP 100 of the present embodiments, the measurements of brightness, brightness ratio, and color temperature of a peak generated in a unit pixel are shown in Table 1.

Unlike the PDP 100 according to the exemplary embodiment, the conventional PDP includes transparent electrodes, which are not separated into pixel units but serially arranged across discharge cells in the same manner as bus electrodes. Also, in a unit pixel of the conventional PDP, a discharge cell in which a G phosphor layer is formed is disposed in the middle of the unit pixel instead of a discharge cell in which a B phosphor layer is formed.

TABLE 1

| | | Conventional PDP | PDP of the Present Embodiments |
|---|---|---|---|
| Brightness (cd/m$^2$) | R phosphor | 230.0 | 184.3 |
| | G phosphor | 519.0 | 510.0 |
| | B phosphor | 84.0 | 94.5 |
| Brightness Ratio (%) | R phosphor | 27.6 | 25.8 |
| | G phosphor | 62.3 | 62.6 |
| | B phosphor | 10.1 | 11.7 |
| Color Temperature (K) of Peak | | 7,860 | 9,080 |

When looking into the measurements shown in Table 1, it can be seen that the R phosphor of the conventional PDP had a brightness ratio of 27.6%, while the R phosphor of the PDP 100 of the present embodiments had a lower brightness ratio of 25.8%; the B phosphor of the conventional PDP had a brightness ratio of 10.1%, while the B phosphor of the PDP 100 had a higher brightness ratio of 11.7%; and there was little difference between the brightness ratios (62.3% and 62.6%) of the G phosphors of the conventional PDP and the PDP 100.

Therefore, in comparison to the conventional PDP, the PDP 100 of the present embodiments can greatly reduce a difference in brightness ratio between the R phosphor and the B phosphor from a conventional value of 17.5% to 14.1%. As a result, the color temperature of the peak was elevated from a conventional value of 7,860 K to 9,080 K as can be seen from Table 1.

The PDP 100 of the present embodiments had a much higher color temperature of peak than the conventional PDP, so that no downward adjustment of brightness is required to increase color temperature. Accordingly, the PDP 100 does not decline in the entire brightness.

As explained thus far, the present embodiments structurally improves discharge cells and electrodes of a PDP, so that the PDP can keep up high brightness and enhance color temperature.

Also, since most consumers prefer high color temperature, it is expected that they will be highly motivated to purchase display devices including the PDP of the present embodiments.

While the present embodiments have been particularly shown and described with reference to exemplary embodiments thereof, it will be understood by those of ordinary skill in the art that various changes in form and details may be made therein without departing from the spirit and scope of the present embodiments as defined by the following claims.

What is claimed is:

1. A plasma display panel comprising:

a first substrate;

a second substrate disposed substantially parallel to the first substrate;

partition walls disposed between the first and second substrates defining discharge cells in which gas discharge occurs;

a plurality of phosphor layers, wherein each phosphor layer is disposed in one of the discharge cells and formed by coating any one of red, green, or blue phosphors; and a unit pixel comprising:

a plurality of discharge cells; and a plurality of discharge electrodes disposed such that they cross the respective discharge cells positioned in the unit pixel, wherein the area in which the discharge electrodes cross at least one discharge cell is different from the area in which the discharge electrodes cross the remaining discharge cells; and wherein the discharge cells are substantially the same size; and wherein the area in which the discharge electrodes cross the discharge cell in which a blue phosphor layer is formed in the largest among areas in which the discharge electrodes cross the respective discharge cells positions in the unit pixel and wherein each of the discharge electrodes includes bus electrode disposed above the partition walls and at least one transparent electrodes bonded to the bus electrode; and wherein the transparent electrodes have the shape of a ladder formed in each unit pixel and the transparent electrodes in the adjacent unit pixels are electrically connected by the bus electrode but physically separated.

2. The plasma display panel of claim 1, wherein the discharge cell in which a blue phosphor layer is formed is disposed at or near the middle of the unit pixel.

3. The plasma display panel of claim 1, wherein the transparent electrodes comprise indium tin oxide (ITO).

4. The plasma display panel of claim 1, wherein the plurality of discharge electrodes is spaced apart from the first substrate.

5. The plasma display panel of claim 1, further comprising an address electrode formed on the second substrate.

6. The plasma display panel of claim 5, further comprising a dielectric layer formed on the address electrode.

7. The plasma display panel of claim 1, wherein the partition walls are formed such that the discharge cells have a shape selected from the group consisting of square, triangular, pentagonal, hexagonal, elliptical, circular and rectangular.

* * * * *